US006618700B1

(12) United States Patent
Thyssen et al.

(10) Patent No.: US 6,618,700 B1
(45) Date of Patent: Sep. 9, 2003

(54) SPEECH CODER OUTPUT TRANSFORMATION METHOD FOR REDUCING AUDIBLE NOISE

(75) Inventors: Jes Thyssen, Laguna Niguel, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 0 days.

(21) Appl. No.: 09/657,260

(22) Filed: Sep. 7, 2000

Related U.S. Application Data

(63) Continuation-in-part of application No. 09/127,881, filed on Jul. 31, 1998, now abandoned.

(51) Int. Cl.[7] ..... G10L 19/00
(52) U.S. Cl. ..... 704/230; 704/500; 704/503
(58) Field of Search ..... 704/230, 225, 704/226, 500–507

(56) References Cited

U.S. PATENT DOCUMENTS

| | | | |
|---|---|---|---|
| 4,507,792 | A | 3/1985 | Yamakido et al. |
| 5,121,391 | A | 6/1992 | Paneth et al. |
| 5,177,734 | A | 1/1993 | Cummiskey et al. |
| 5,267,262 | A | 11/1993 | Wheatley, III |
| 5,666,659 | A | 9/1997 | Kernahan et al. |
| 5,692,105 | A | 11/1997 | Leppänen et al. |
| 5,734,967 | A | 3/1998 | Kotzin et al. |
| 5,784,406 | A | 7/1998 | DeJaco et al. |
| 5,878,329 | A | 3/1999 | Mallinckrodt |
| 5,926,505 | A | 7/1999 | Long |
| 5,943,365 | A | 8/1999 | Long et al. |

FOREIGN PATENT DOCUMENTS

| | | |
|---|---|---|
| EP | 0 381 215 A2 | 8/1990 |
| GB | 2064276 A | 6/1981 |
| WO | WO 00/07178 | 2/2000 |

*Primary Examiner*—Doris H. To
*Assistant Examiner*—Michael N. Opsasnick
(74) *Attorney, Agent, or Firm*—Farjami & Farjami LLP

(57) ABSTRACT

In a cellular telephone system where a digital cellular telephone is connected to a regular telephone through the public switched telephone network (PSTN), a speech encoder/decoder is used with an A/$\mu$-Law encoder/decoder causing annoying audible noise at very low levels because of the quantization characteristics of the A/$\mu$-Law encoder/decoder. This noise is eliminated by adding a digital constant to the output of the speech coder, shifting the low level signal away from zero. The resulting DC level added to the speech signal is inaudible to the PSTN telephone user and does not degrade speech quality. Alternatively, the constant added to the output of the speech coder is confined to a small value added to the speech coder output to move the entire speech coder output during the silence period, between speech periods, above zero or below zero.

16 Claims, 3 Drawing Sheets

SPEECH CODER OUTPUT TRANSFORMATION METHOD FOR REDUCING AUDIBLE NOISE

CROSS REFERENCE TO RELATED APPLICATIONS

This application is a continuation-in-part of application Ser. No. 09/127,881 abandoned filed Jul. 31, 1998 for Method And Apparatus For Speech Code Output Transformation.

BACKGROUND OF THE INVENTION

1. Field of the Invention

The subject invention relates generally to communication systems and more particularly to a method and apparatus for improving communication between a cellular phone and a phone on the PSTN network whenever a digital speech compression algorithm is followed by an compander conversion, which is typical.

2. Description of Related Art

In the prior art, situations arise where a digital cellular phone (e.g., GSM, PCS- 1800, IS-54) is connected to a telephone on the public switched telephone network (PSTN). Such cellular systems typically employ a speech coder followed by a compander, such as a $\mu$-Law or A-Law conversion, in order to interface to the PSTN network. Due to the "poor" quantization characteristics of A-Law and to a lesser extent of the $\mu$-Law conversion, at very low levels (hardly audible), the output of the speech coder are transformed into an annoying audible noise after the A/$\mu$-Law conversion at the receiving PSTN phones. The problem becomes worse as the bit-rate of the speech coding algorithm decreases and is most noticeable if a level adjustment (increase) takes place after the A/$\mu$-Law decoding.

SUMMARY OF THE INVENTION

It has been discovered that annoying audible noise during speech intervals can be eliminated by adding a fixed number in the digital domain to the output of the speech coder. In this manner, signal samples shifting around zero are moved away from the area of "poor" quantization of the compander. The invention would typically be a part of the speech decoder algorithm, as a post operation. However, it can be used as successfully, as a stand alone block between any speech decoding algorithm and the A-Law or $\mu$-Law conversion (compander). Adding a fixed number to the output of the speech decoder is inaudible, and does not degrade speech quality in any way. The technique eliminates the problem for any bit-rate. The effect is dramatic and will solve the noise problem for most existing standards. Alternatively, the constant added to the output of the speech coder is confined to a small value added to the speech coder output so that during the silence period between speech, when the output of the coder falls slightly below zero or slightly above zero, the constant value moves the entire speech coder output during the silence period slightly above zero or slightly below zero.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

Figure 1:
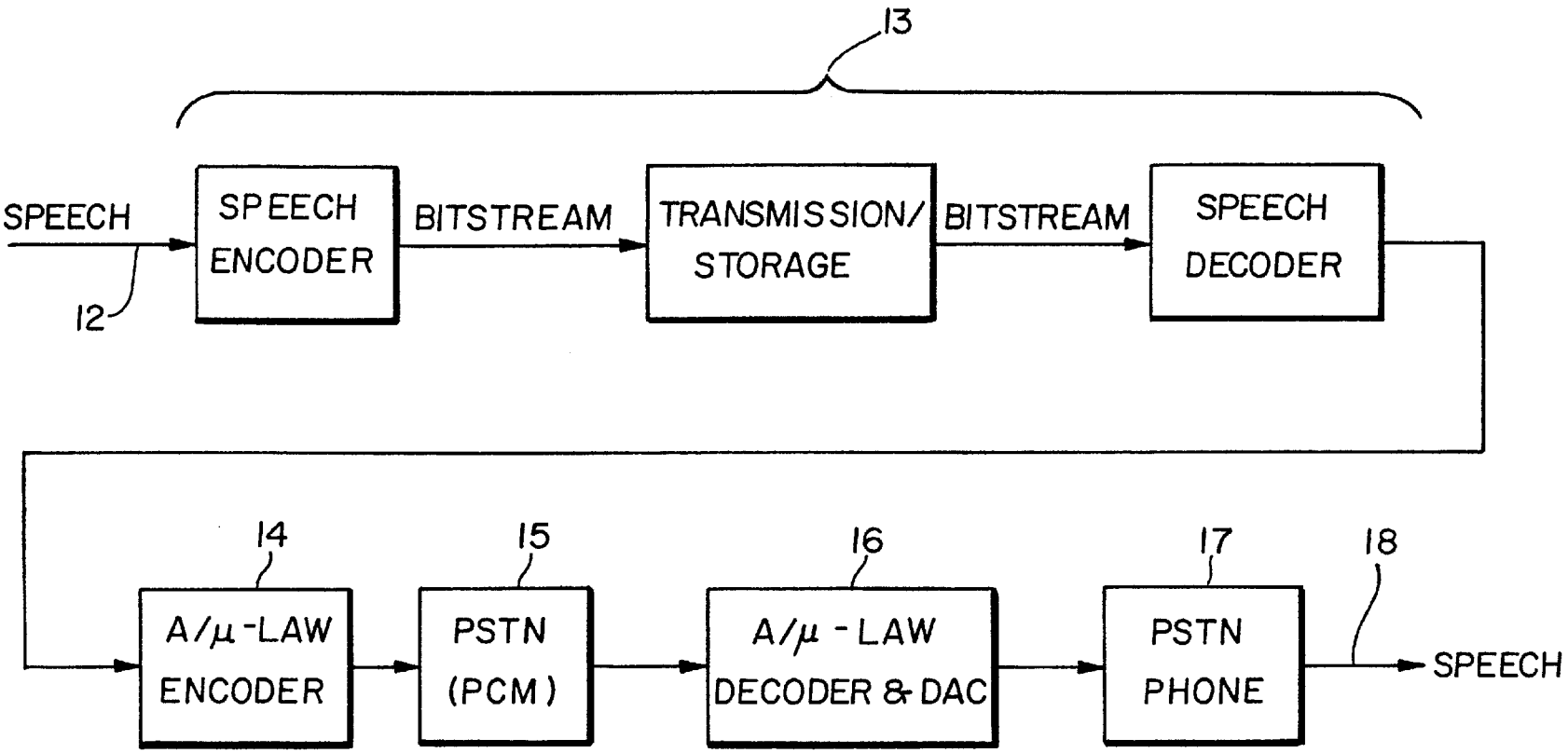
FIG. 1 is a block diagram illustrating a typical interface between a digital speech coding algorithm and the PSTN network through an A/$\mu$-Law conversion (compander).

The following description is provided to enable any person skilled in the art to make and use the invention and sets forth the best modes contemplated by the inventors of carrying out their invention. Various modifications, however, will remain readily apparent to those skilled in the art:

FIG. 1 illustrates a speech encoder/decoder 13 supplying an output signal to an A/$\mu$-Law encoder 14 interfacing with the public switched telephone network (PSTN) 15. At the central office, the PSTN 15 interfaces with an analog telephone line to a subscriber telephone 17 through an A/$\mu$-Law decoder and digital to analog converter (DAC) 16. The subscriber uses a standard PSTN telephone 17 for speech communication 18. In this configuration, a low signal level of the output of the speech coder 13, which occurs typically between speech intervals is transformed by the A/$\mu$-Law conversion into an annoying audible noise at the receiving PSTN telephone 17.

Figure 2:
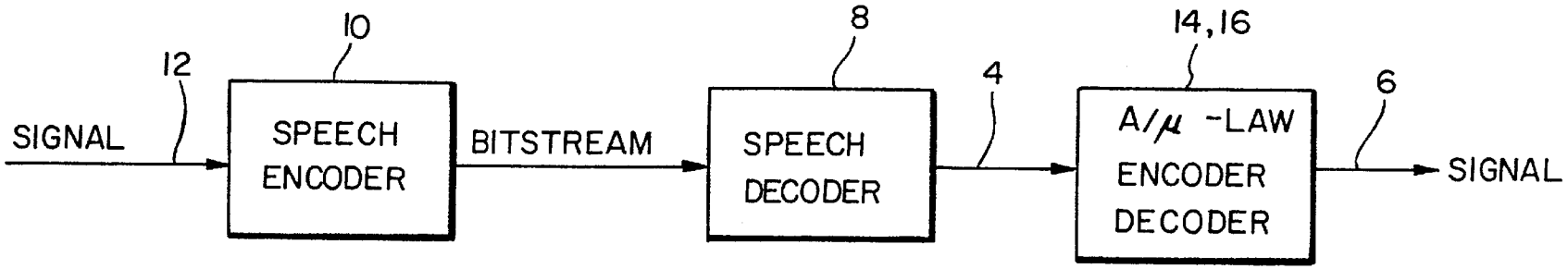
FIG. 2 is a block diagram illustrating how the interface of FIG. 1 is usually simulated.

The typical interface to the public switch telephone network (PSTN) 15 as illustrated in FIG. 1 is usually implemented in the manner shown in FIG. 2 wherein a speech signal 12 from a cellular telephone is encoded by a speech encoder 10 into a bit stream for transmission across the transmission medium to a speech decoder 8 which converts the bit stream into an output signal, 4. The output signal 4 is supplied to the A/$\mu$-Law encoder/decoder 14, 16 which generates a signal 6 that is presented to the PSTN telephone.

Figure 3:
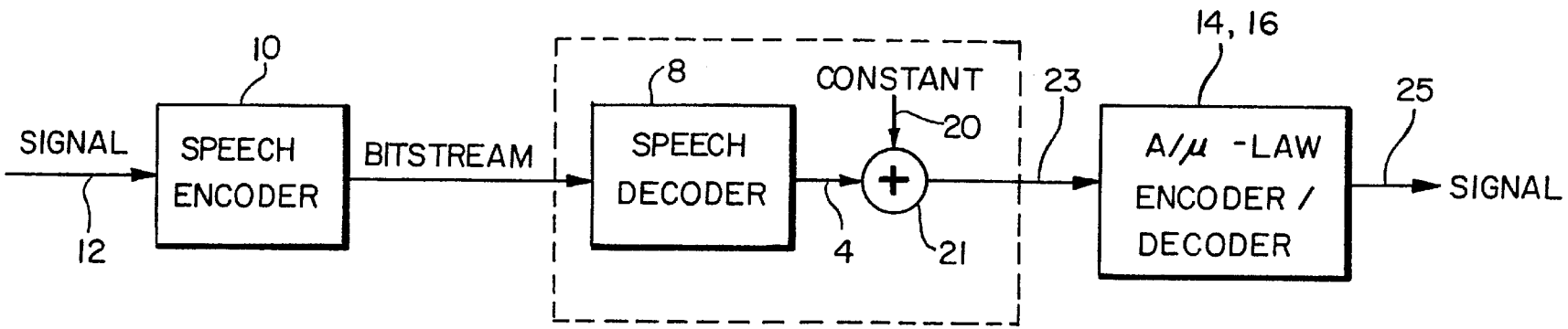
FIG. 3 is a block diagram illustrating the preferred embodiment of the invention.

The preferred embodiment of the present invention is illustrated in FIG. 3, as an add-on to the typical PSTN interface. A cellular signal input 12 to a speech encoder 10 supplies a bit stream to a speech decoder 8 which outputs a signal 4. The signal 4 from the speech decoder 8 is at a low level when the input signal 12 to the speech encoder 10 is at a low level, typically when there is silence between speech. Instead of supplying the signal 4 to the A/$\mu$-Law encoder/decoder, the present invention, by way of digital adder 21, adds an offset 20, which is preferably a fixed number (constant), to the signal 4 from the speech decoder 8 in the digital domain. Adding a constant to signal 4 causes the data signal to shift away from the area of "poor" quantization for the A/$\mu$-Law converter.

It is important to note that adding a constant, a fixed number, for example the number 6, to the signal stream 4 does not degrade the speech quality at the PSTN telephone 17, while it does eliminate the annoying audible noise inherent in the prior art system of FIG. 2. This is true for many speech coding standards, such as, ITU, ETSI, TIA, for example. By adding the constant 20 to signal 4 at the digital level through adder 21 a shifting of the signal away from 0 occurs creating shifted signal 23. The shifted signal 23 is supplied to the A/$\mu$-Law encoder/decoder 14, 16 which supplies its output signal 25 to the PSTN telephone 17.

Figure 4:
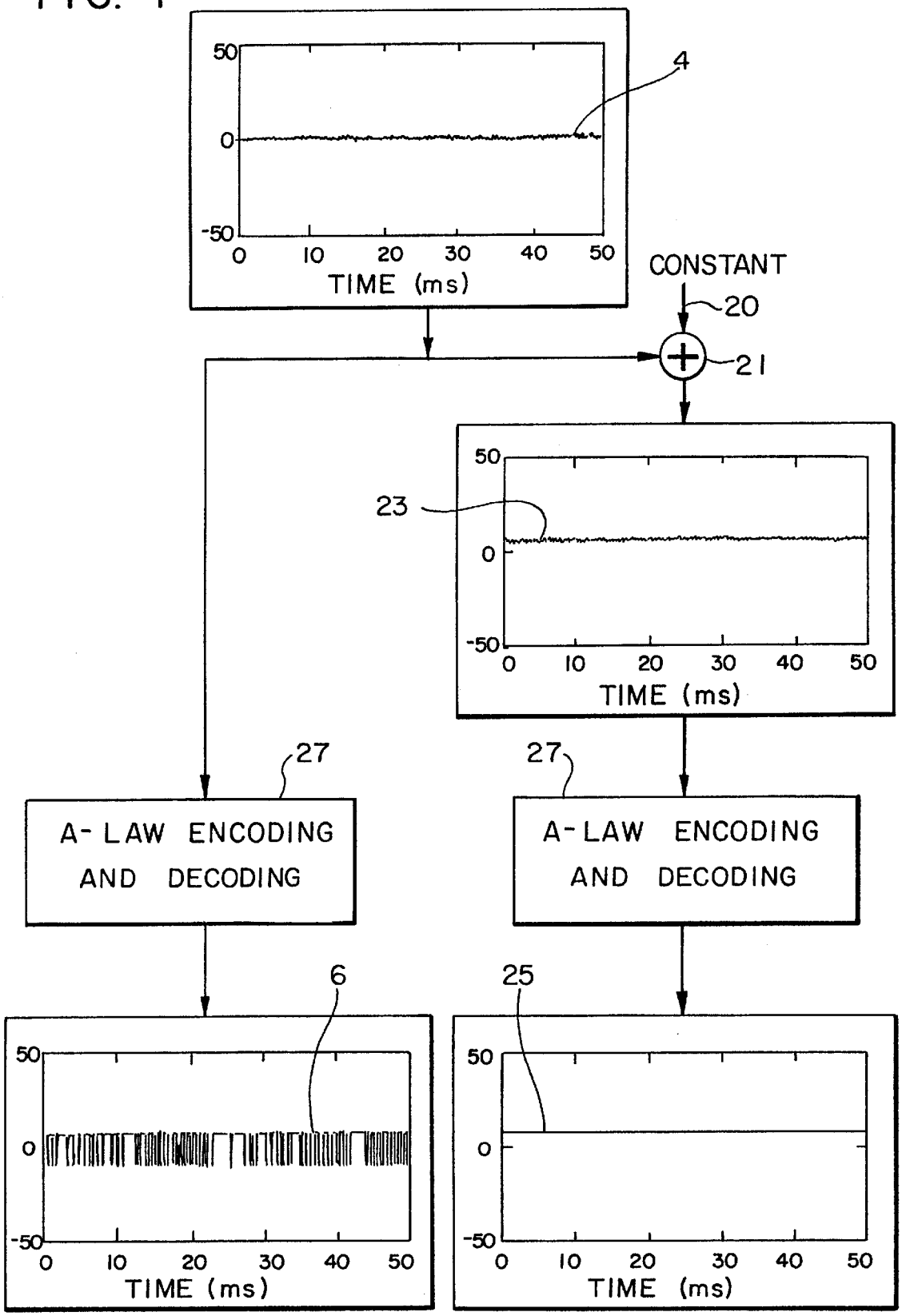
FIG. 4 is a block and waveform diagram illustrating the advantage of the invention over the prior art.

FIG. 4 illustrates how well the invention performs as compared to the prior art, such as illustrated in FIG. 2. A typical low level output signal 4 from a speech decoder which occurs, typically during periods of silence between speech, is shown as a time varying signal of very low amplitude varying around 0. In the prior art system of FIG. 2, this signal 4 is provided to an A-Law encoder/decoder or $\mu$-Law encoder/decoder. In this example, an A-Law encoder/decoder 27 is shown because the problem is much more pronounced in this encoder/decoder. The A-Law encoder/decoder generates an output signal 6 in response. As can be seen, the output signal 6, which started out as a low level signal 4 now has a significant higher amplitude varying around 0. This signal is perceptually annoying to the PSTN telephone user and results in degraded overall speech quality.

The invention of FIG. 3, takes the signal 4 from the speech decoder 8, and adds a constant 20, like the number 6, for example, to the signal 4 causing it to shift a constant level away from 0, as in signal 23. The shifted signal 23 is supplied to the A-Law encoder/decoder 27 producing output signal 25, which is shifted away from 0 by a DC offset, but without the large amplitude variation. This DC offset is inaudible to the human ear. The ear hears offset signal 25 as silence, rather than the annoying noise generated by the amplitude varying signal 6.

In order to eliminate such a large DC offset signal during the silence period between speech, a second embodiment of the present invention adds the constant 20 only to values of the audio output 4 of the speech decoder 8 that fall within a certain range of digital values. To better understand how this embodiment can eliminate audible noise during the silence between speech, the cause of the audible noise is explained with reference to FIG. 4.

FIG. 4 shows a low level audio output 4 that varies slightly about zero during the silence between speech. The value of zero lies within an area of "poor" quantization of a A-Law compander 27, in which values of the audio output 4 that are equal to or slightly above zero are quantized as +8, and values that are slightly below zero are quantized as −8. As a result, the quantized output 6 of the A-Law compander 27 has an amplitude that varies between +8 and −8. This relatively large amplitude variation of the quantized output 6 produces an annoying audible noise at the PSTN telephone during the silence between speech.

The second embodiment of the present invention eliminates this noise by adding the constant 20 only to values of the audio output 4 that fall within a certain range of values. This can be done by choosing a range of values that include the values of the audio output 4 that are slightly below zero during the silence between speech, and adding a positive constant 20 that shifts these values to zero or above. That way, the values of the audio output 4 that are slightly below zero during the silence between speech are shifted to zero or above by the constant 20. As a result, all of the values of the audio output 23 after the adder 21 are quantized the same by the compander 14, 16 during the silence between speech. This causes the quantized output 25 of the compander 14, 16 to have a constant amplitude during the silence between speech, thereby eliminating the audible noise caused by large amplitude variation. The constant amplitude of the quantized output 25 is perceived as silence by the human ear at the PSNT telephone, rather than an annoying audible noise.

In one example, the range of values is −1 or −2, and the constant 20 is a +2. The logical function for the adder 21 in this example is given by:

$$x_1(n)=x(n)+2 \text{ if } x(n)=-1 \text{ or } -2,$$

$$\text{otherwise } x_1(n)=x(n)$$

where x(n) is the audio output 4 of the speech decoder 8 and $x_1(n)$ is the audio output 23 after the adder 21. This logical function only adds the constant 20 of a +2 for values of the audio output 4 in the range of −1 or −2. However, it is also contemplated that a +2 value could be added to all negative values of the audio output 4. A +2 value would be added to any value within the range slightly below zero to −32,768, the maximum number of representations possible in a sixteen bit word below zero. Assuming that the values of the audio output 4 that are below zero during the silence between speech are either −1 or −2, the constant 20 shifts these values to zero or 1. As a result, the values of the audio output 23, after the adder 21, are quantized the same by the compander 14, 16 during the silence between speech. This causes the quanitized output 25 of the compander 14, 16 to have a constant amplitude during the silence between speech, thereby eliminating the audio noise caused by the large amplitude variation.

The same result can be achieved by choosing a range of values that include the values of the audio output 4 that are equal to or slightly above zero during the silence between speech, and adding a negative constant 20 that shifts these values below zero. That way, the values of the audio signal 4 that are equal to or slightly above zero during the silence between speech are shifted below zero by the constant 20. As a result, all of the values of the audio output 23, after the adder 21, are quantized the same by the compander 14, 16 during the silence between speech. This causes the quanitized output 25 of the compander 14, 16 to have a constant amplitude during the silence between speech, thereby eliminating the audible noise caused by the large amplitude variation. Thus, a −2 value could be added to all the positive values of the audio output 4. A −2 value would be added to any value within the range zero to +32,767, the maximum number of representations possible in a sixteen bit word above zero.

The second embodiment of the present invention can be implemented in the speech decoder 8, as a post operation. In this case, the speech decoder 8 performs the constant addition according to the second embodiment after decoding the incoming speech signal 10 into the digital audio output 4.

What is claimed is:

1. In a speech communication system having a speech decoder followed by a compander, the speech decoder having an output signal with a plurality of output values, a method for reducing audible noise generated by the compander during the absence of a voice signal, the steps of the method comprising:

selecting a range of output values from the plurality of output values of the output signal, wherein the range of output values is defined by the output values of less than zero and greater than or equal to −2;

calculating each output value of the plurality of output values;

determining if an output value of the plurality of output values falls within the range;

adding a predetermined constant value to the output signal if the determining determines that the output value of the plurality of output values falls within the range; and supplying the output signal to the compander.

2. The method of claim 1 wherein the constant value added to the output signal of the decoder is a +2 value that moves all the −1 and −2 portions of the speech decoder output signal to a positive level or zero level.

3. The method of claim 1 wherein the compander is an A-Law converter.

4. The method of claim 1 wherein the compander is a $\mu$-Law converter.

5. In a speech communication system having a speech decoder followed by a compander, the speech decoder having an output signal with a plurality of output values, a method for reducing audible noise generated by the compander during the absence of a voice signal, the steps of the method comprising:

selecting a range of output values from the plurality of output values of the output signal, wherein the range of output values is defined by the output values of greater than zero and less than or equal to +2;

calculating each output value of the plurality of output values;

determining if an output value of the plurality of output values falls within the range;

adding a predetermined constant value to the output signal if the determining determines that the output value of the plurality of output values falls within the range; and supplying the output signal to the compander.

6. The method of claim 5 wherein the constant value added to the output signal of the decoder is a −2 value that moves all the +1 and +2 portions of the speech decoder output signal to a negative level or zero level.

7. The method of claim 1 wherein the compander is an A-Law converter.

8. The method of claim 1 wherein the compander is a $\mu$-Law converter.

9. In a speech communication system having a speech decoder followed by a compander, the speech decoder configured to cause a reduction in audible noise generated by the compander during the absence of a voice signal, the speech decoder comprising:

an output signal with a plurality of output values;

a controller configured to select a range of output values from the plurality of output values of the output signal, wherein the range of output values is defined by the output values of less than zero and greater than or equal to −2, the controller further configured to calculate each output value of the plurality of output values and determine if an output value of the plurality of output values falls within the range;

an adder configured to add a predetermined constant value to the output signal if the controller determines that the output value of the plurality of output values falls within the range; and an output supplier configured to supply the output signal to the compander.

10. The method of claim 9 wherein the compander is an A-Law converter.

11. The method of claim 9 wherein the compander is a $\mu$-Law converter.

12. In a speech communication system having a speech decoder followed by a compander, the speech decoder configured to cause a reduction in audible noise generated by the compander during the absence of a voice signal, the speech decoder comprising:

an output signal with a plurality of output values;

a controller configured to select a range of output values from the plurality of output values of the output signal, wherein the range of output values is defined by the output values of greater than zero and less than or equal to +2, the controller further configured to calculate each output value of the plurality of output values and determine if an output value of the plurality of output values falls within the range;

an adder configured to add a predetermined constant value to the output signal if the controller determines that the output value of the plurality of output values falls within the range; and an output supplier configured to supply the output signal to the compander.

13. The method of claim 12 wherein the compander is an A-Law converter.

14. The method of claim 12 wherein the compander is a $\mu$-Law converter.

15. The speech decoder of claim 9, wherein the constant values added to the output signal of the decoder is a +2 value that moves all the −1 and −2 portions of the speech decoder output signal to a positive level or zero level.

16. The speech decoder of claim 12, wherein the constant values added to the output signal of the decoder is a −2 value that moves all the +1 and +2 portions of the speech decoder output signal to a negative level or zero level.

* * * * *